US006910566B2

(12) United States Patent
Abe et al.

(10) Patent No.: US 6,910,566 B2
(45) Date of Patent: Jun. 28, 2005

(54) COIN RECEIVING AND DISPENSING DEVICE

(75) Inventors: Hiroshi Abe, Iwatsuki (JP); Masayoshi Umeda, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 181 days.

(21) Appl. No.: 10/382,156

(22) Filed: Mar. 5, 2003

(65) Prior Publication Data

US 2004/0173433 A1 Sep. 9, 2004

(51) Int. Cl.[7] ..... G07F 9/10
(52) U.S. Cl. ..... 194/350; 194/302
(58) Field of Search ..... 104/302, 344, 104/350, 353; 193/DIG. 1; 221/154, 282, 287; 453/3, 61, 63; 312/215, 270.1, 270.2, 291, 270.3

(56) References Cited

U.S. PATENT DOCUMENTS 478,714 A * 7/1892 Reford ..... 194/250
5,082,099 A * 1/1992 Abe ..... 194/338
5,356,332 A 10/1994 Thompson et al. ..... 453/3
6,261,169 B1 * 7/2001 Ishida et al. ..... 453/17

FOREIGN PATENT DOCUMENTS

JP 05-258155 10/1993 ..... G07F/3/00

* cited by examiner

*Primary Examiner*—Donald P. Walsh
*Assistant Examiner*—Mark J. Beauchaine

(57) ABSTRACT

A coin receiving and dispensing device includes a coin selector unit with a coin entry for determining a type of coin and directing the coin based on that determination. A coin dispensing device for storing coins that can be dispensed as change and a coin storage safe along with a return coin exit can also be provided. A coin passageway unit that can include a removable cover member can extend over and form a portion of the coin passageways whereby a technician by removing the cover member can have access to the servicing of the various coin passageways.

17 Claims, 5 Drawing Sheets

COIN RECEIVING AND DISPENSING DEVICE

BACKGROUND OF THE INVENTION

1. Field of the Invention

The present invention is directed to a coin receiving and dispensing device of a compact configuration which can be mounted, for example, in a vending machine or other device for receiving, storing, and dispensing coins, and more particularly includes a coin passageway unit with a removable cover member that expose a plurality of coin passageways for cleaning and servicing.

2. Description of Related Art

Various forms of coin receiving and dispensing devices, sometimes referred to as coin mechanical devices, are known in the prior art. Various forms of vending machines, money changing machines, and service devices are equipped with a coin processor which can verify inserted coins, sort the coins by denomination, store coins, return coins, and can pay out change of lesser denominations than the coin denomination inserted. An example of a coin processor can be seen in the Japanese laid-open publication No. 5-258155.

The high cost of labor has created opportunities for remote automatic coin receiving and dispensing devices which are frequently incorporated in kiosk stand-alone unit, such as a box-like structure that can be provided to monitor parking spots. Frequently, in such an environment, the received coins are at most two denominations and a return coin or change coin is generally of a one denomination value. For example, if a parking fee is 100 Yen per thirty minutes, the receiving coins can either be 100 Yen or 500 Yen denominations and the change dispensing coins will be only of 100 Yen denominations.

As can be appreciated during the service life of such a device, there can be an accumulation of debris, and dirt, particularly if the kiosk is positioned outside. As a result, coins can jam and it is necessary to periodically clean coin passageways to ensure proper operation.

There is still demand in this field to provide a relatively cost efficient and compact coin payment and change device that can incorporate a coin receiving and dispensing device that is easily serviced.

SUMMARY OF THE INVENTION

The present invention provides a coin receiving and dispensing device that can incorporate a coin selector unit with a coin entry for determining a type of coin and then appropriately directing a coin based on that determination. The determination can also determine or verify whether it is a legitimate coin and subsequently deal with the coin on the basis of that determination. A coin dispensing device for storing coins that can be dispensed as changed is also provided and a receiving groove extends from the coin selector unit to the coin dispensing device. A removable cover member that extends over the receiving groove and forms with the receiving groove a first coin passageway between the coin selecting unit and the coin dispensing device is provided and can be removed by a service technician to thereby provide easy access to the open coin passageway for cleaning.

A coin returning unit can also be operatively connected to the coin selector unit and can include a returning groove that will return rejected coins to an exit opening. The cover member also extends over the returning groove and forms with the returning groove a second coin passageway between the coin selector unit and the coin returning unit. A coin storage passageway for storing desired coins can also be provided with the coins being deposited in a coin storage safe. The movable cover member can also form a portion of the coin storing passageway. Thus, a coin passageway unit can be provided having one or more coin passageways wherein a removable cover member can provide a relatively inexpensive and efficient component that can be easily removed by a service technician. The coin receiving and dispensing device can be further mounted in a vending machine, money changer, etc. on a movable and lockable lid cover so that when the lid cover is pivoted, for example, about hinges, the coin receiving and dispensing device is rotated out of the housing for servicing by the technician. The coin dispensing device can further have a motor driven member which can be activated by sensors determining the presence of a particular coin denomination for causing the coin dispensing device to eject the appropriate change to the user.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provide to enable any person skilled in the coin vending art to make and use the invention and sets forth the best modes contemplated by the inventors of carrying out their invention. Various modifications, however, will remain readily apparent to those skilled in the art, since the general principles of the present invention have been defined herein specifically to provide a compact coin dispensing device with a passageway unit that can be easily serviced.

Figure 1:
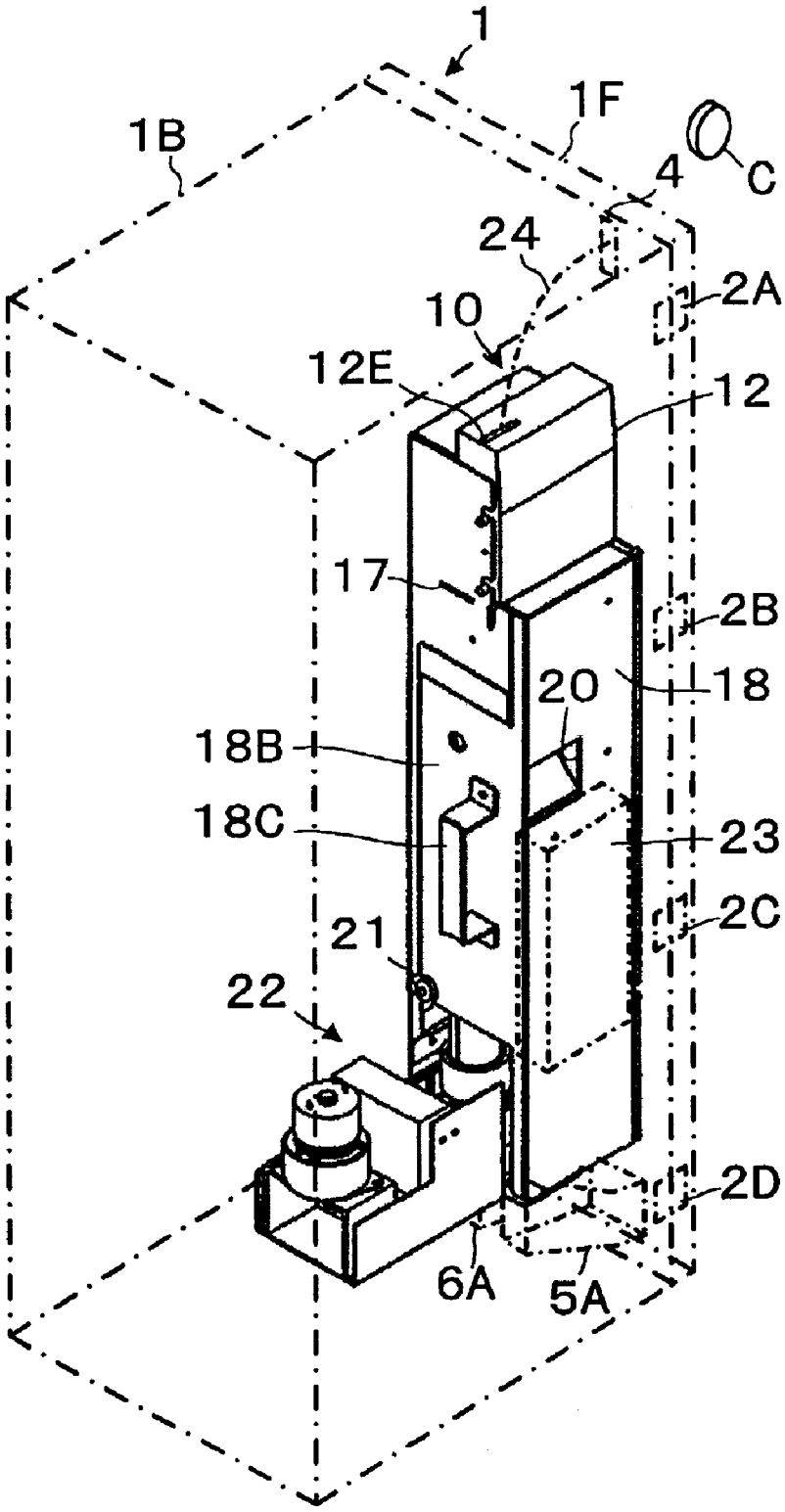
FIG. 1 is a perspective view of a check-out device with a built-in receiving and dispensing device of the present invention.

Now a check-out device 1 such as a parking lot automatic attendant is explained by referring to FIG. 1. The check-out device 1 has an exterior box-like housing and includes a base-box 1B and a front lid 1F. It can be located at a parking lot for paying for a vehicle space. The lid or first cover member 1F can pivot about the hinges 2A, 2B, 2C, 2D to provide access to the internal equipment and money contained therein.

Figure 2:
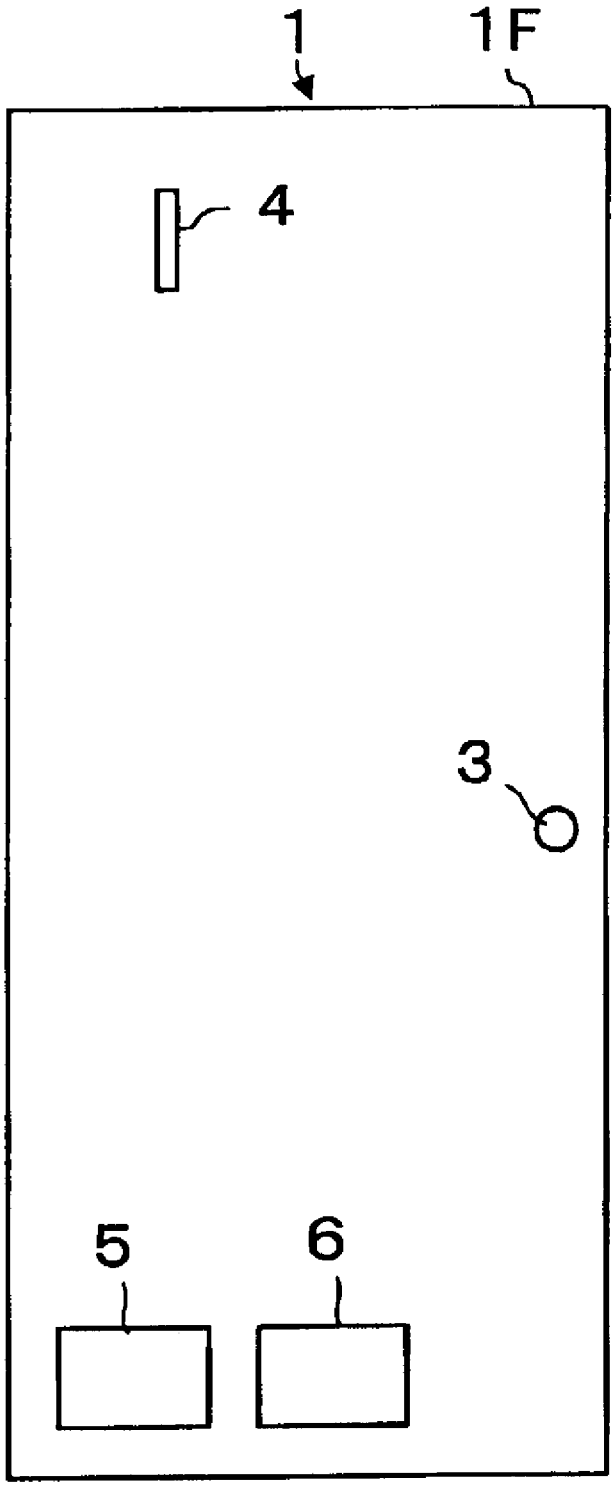
FIG. 2 is a front view of the check-out device.

As shown in FIG. 2, the lid 1F is locked to the base-box 1B by a lock 3. A receiving and dispensing device 10 is fixed in the box 1B at the reverse side of the lid 1F. When the lid 1F is opened, the receiving and dispensing device 10 can be moved integrally as one unit for access.

As shown in FIG. 2, a coin entry slot or coin receptor 4 is located at the upper section of the lid 1F. A coin returning exit 5 and a change exit 6 are located at the lower section of the lid 1F. The coin returning exit 5 connects to a coin returning passageway 5A which also slants downward in the box 1B. The change exit 6 connects to a change passageway 6A which is also configured to slant downward.

Figure 3:
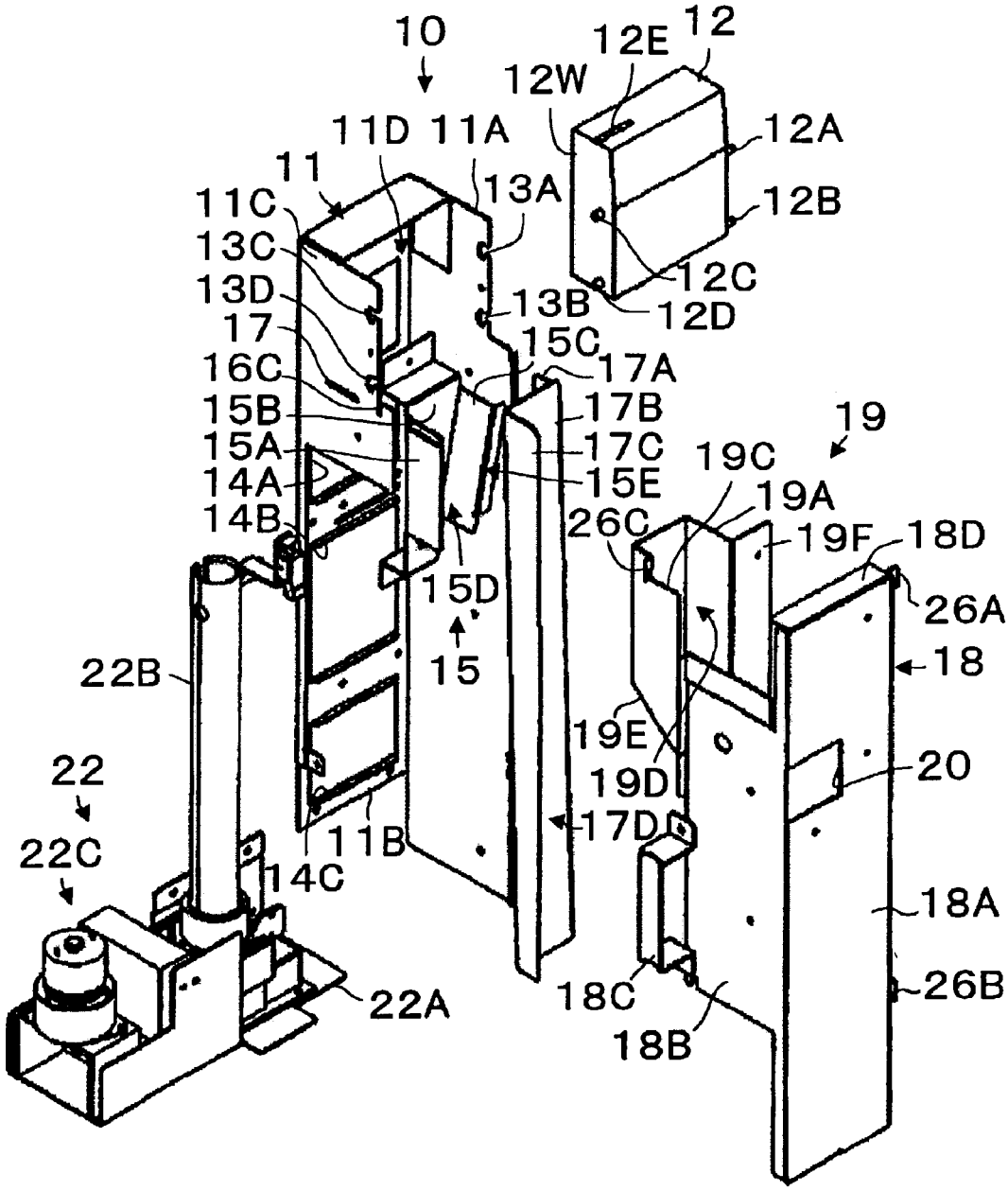
FIG. 3 is a exploded perspective view of the receiving and returning device of the present invention.

The receiving and dispensing device 10 is further explained by referring to FIG. 3. Frame 11 includes a base board 11A, a side board 11B and guide board 11C and they are joined together in a rectangle configuration to provide a groove 11D which is longer than it is wide and has a channel-like shape. The base board 11A is fixed at the reverse side of the lid 1F by screws, etc. Openings 14A, 14B, 14C are located along the side board 11B for visual observation by a service technician.

Coin selector unit 12 is in a box-like configuration and is detachably mounted to be hung on frame 11. The coin selector unit 12 has two support pins, and the pins are located at a front wall (not shown) and at rear wall 12W. Therefore the pins 12A and 12B of the front wall have contact with contacting grooves 13A and 13B which are L-shape and are located on the base-board 11A. The pins 12C and 12D extending from the rear wall have contact with contacting grooves 13C and 13D which are L-shape and are located at the base board 11A.

The coin selector unit 12 has a function of distinguishing or verifying the authenticity of the receiving coins and to accordingly dispense them to one of the receiving exit 12F, the returning exit 12G and the storing exit 12H. The coin selector unit 12 can be either a mechanical type or an electrical type as known in the vending industry.

Receiving gutter 15 is fixed at the side board 11B and is located below the coin selector unit 12 as shown in FIG. 3. The receiving gutter 15 which is extended in the longitudinal direction is channel-like in shape and is structured by the side walls 15A, 15B and 15C to form a receiving groove 15D. Receiving groove 15D is funnel-like in shape.

Figure 4:
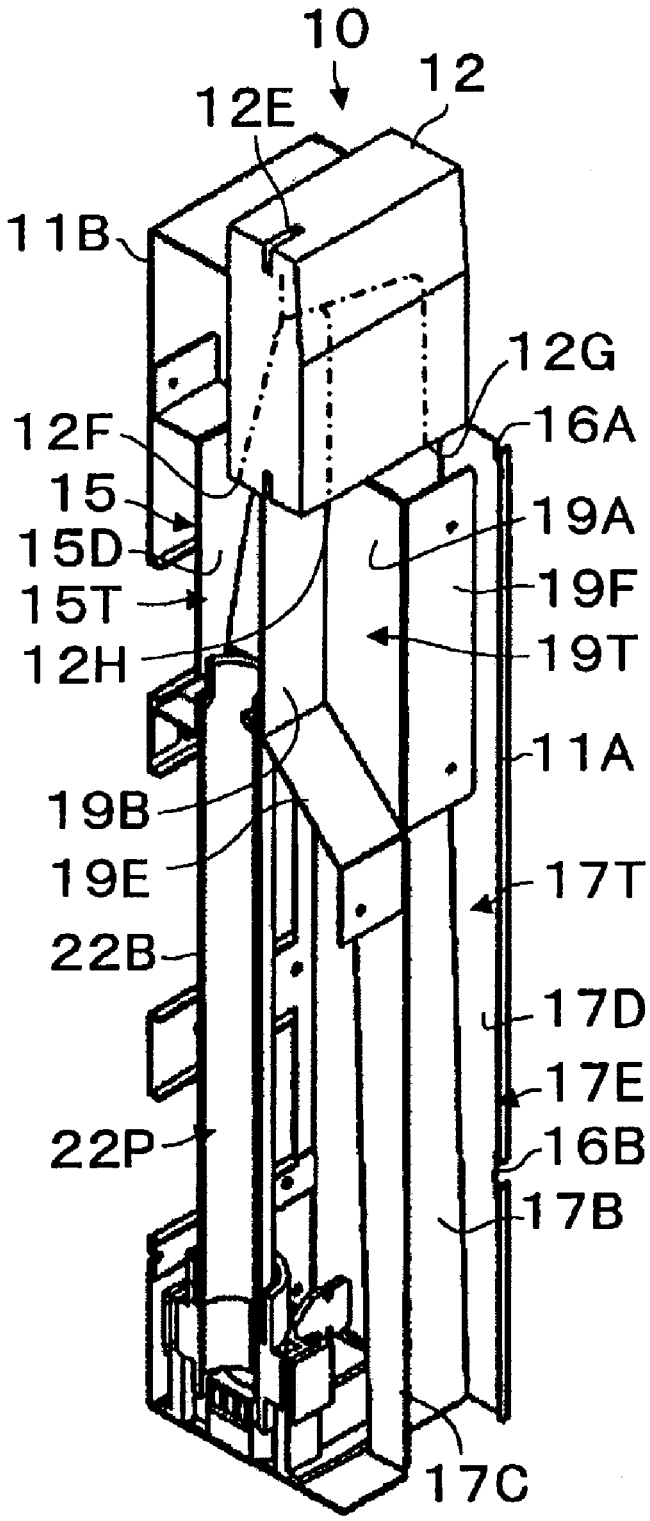
FIG. 4 is a partial cross-sectional perspective view of the present invention.

The upper end of the receiving groove 15D is located under the receiving exit 12F of coin selector unit 12 and the lower end is located over a storing pipe or tube 22B which is cylindrical in shape, as shown in FIG. 4. The opening 15E of the receiving gutter 15 opens opposite to the side board 11B. The side wall 15A has contact with the guide board 11C. Thus, coins that can be returned as change can be appropriately stored.

An auxiliary coin entry 17 is provided in the guide board 11C and is located under the receiving exit 12E and opens at the receiving groove 15D. The side wall 15A can be alternatively formed as part of the guide board 11C as a modification.

The returning groove 17D is fixed at the base board 11A. The returning groove 17D includes an attaching wall 17A for connection to base board 11A, side walls 17B and 17C. The cross section of groove 170 is crank-like in shape. As shown in FIG. 4, the returning groove 17D extends in a longitudinal direction and includes base board 11A and side walls 17B and 17C. The upper end of the returning groove 17D is located under the returning exit 12G of coin selector unit 12 and the lower end is located over the coin returning passageway 5A, whereby a rejected coin can be returned to the user. Opening 17E opens opposite to the side board 11B.

A second removable cover 1 8 is structured by a first cover side wall 18A and second cover side wall 18B to provide a cross section having an L-like shape as shown in FIG. 3. Storing mouth or chute 20 is located above the middle of the first cover side wall 18A. Handle 18C is fixed at the surface of the second cover side wall 18B to enable a service technician to remove the cover 18 when the first cover member 1F of the check-out device 1 is opened. Storing gutter 19 is located behind the first cover wall 18A and it's cross section is channel-like in shape.

The storing gutter 19 has a storing groove 19D shown in FIG. 3 which extends in a longitudinal direction and is made up of the side walls 19A, 19B and 19C. The lower end of the storing groove 19D is closed by a bottom wall 19E which slants in a direction opposite to the side board 11B. Attaching wall 19F of the storing gutter 19 is fixed directly on the rear surface of the first cover side wall 18A.

Therefore a storing passageway 19T is made up of the first cover side wall 18A, and the side walls 19A, 19B, 19C, and extends in longitudinal direction. The depth of the storing passageway 19T is relatively shallow. The lower edge of the bottom wall 19E is located adjacent to the lower edge of the storing mouth 20 which is operatively connected with the safe 23 shown in FIG. 1.

First contacting groove 16A extends in an up and down direction and is located at the upper end of base board 11A. Second contacting groove 16B has an opposite arranged L-shape and is located at the middle of the base board 11A. Third contacting groove 16C extends in both the up and down direction and is located at the upper end of guiding board 11C.

First contacting projection 26A protrudes in the lateral direction and is located at the upper end of the first cover side wall 18A. Second contacting projection 26B protrudes in the lateral direction from the middle of the first cover side wall 18A. Third contacting projection 26C protrudes in the lateral direction from the upper edge of the storing gutter 19.

When the removable cover 18 is attached to the frame 11, the second contacting projection 26B has contact with the second contacting groove 16B and is pushed to the side of the side board 11B. Next, the first contacting projection 16A has contact with the first contacting groove 16A and the third contacting projection 26C has contact with the third contacting groove 16C, and is pushed down.

Therefore the cover 18 is held in a temporary fashion to the frame 11. Next, the cover 18 is fixed at the frame by a fastening unit, for example, a butterfly screw 21 which can be easily operated by the service technician when the first cover lid 1F is opened. The fastening unit could be changed to a known one-touch control member as an alternative embodiment.

In this situation, the second cover side wall 18B is located under the guiding board 11C as shown in FIG. 1. The first cover side wall 18A covers the returning groove 17D. The upper edge 18D of the cover 18 pushes the lower section of the coin selector 12 towards the side and the coin selector 12 is fixed at the frame 11.

When cover 18 is attached at the frame 11, the upper end of the storing groove 19D is located under the storing exit 12H. The first cover 18A covers the opening 17E of the returning groove 17D and constitutes the returning passageway 17T. The side wall 19B of the storing gutter 19 closes the opening 1 5E and constitutes the receiving passageway 15T.

Figure 5:
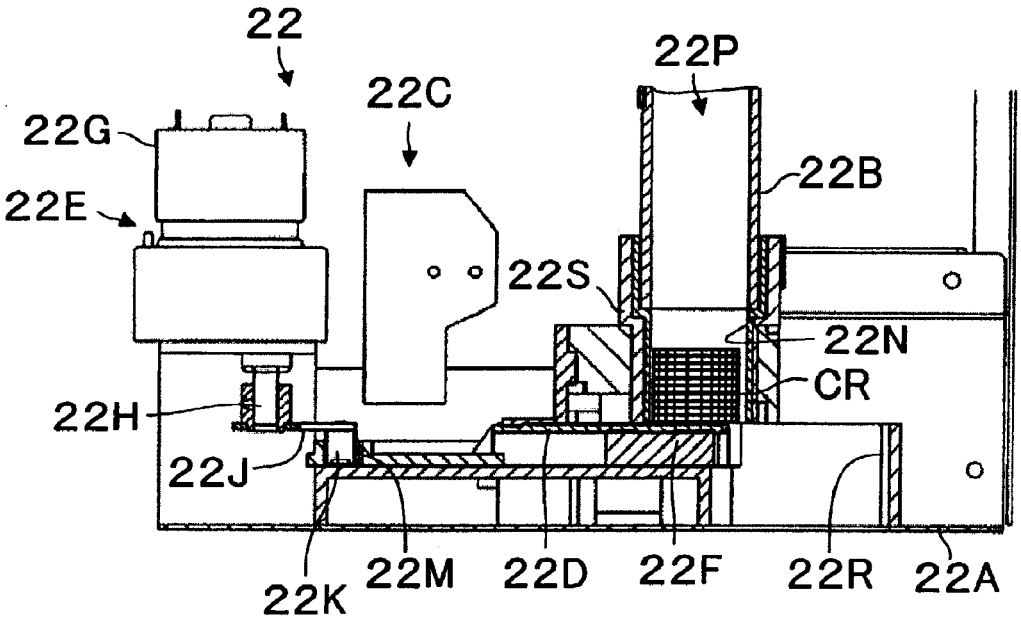
FIG. 5 is a partial cross-sectional view of the dispensing device of the present invention.

When the coin dispensing device 22 is fixed at the side board 11B and includes the storing section 22B which is fixed at the base 22A and the dispensing device 22C. The storing section 22B is cylindrical and the axis is approximately vertical as shown in FIG. 5. The coin dispensing device 22 is fixed at support 22S which is fixed at the base 22A. Storing hole 22N is cylindrical and is located at the support 22S which is located on the extending line of the storing pipe 22B. The storing section 22P includes the storing pipe 22B and the storing hole 22N. The upper end of the storing pipe 22B is located under the receiving passageway 15T.

The dispensing device 22C includes a slider 22D and a driver 22E for the slider 22D. The slider 22D can slide to a slide base 22F which is fixed at the base 22A (in the left and right direction shown in FIG. 5). The slider 22D is located under the storing section 22P, and the end of slider 22D is thinner than the coin's thickness.

The distance between the upper surface of the sliding base 22F and the lower end of the storing section 22P is larger than one coin's thickness and is smaller than two coins' thickness. Disposing passageway 22R is located at the side of sliding base 22F. Charging passageway 6A is located under the dispensing passageway 22R.

Driver 22E includes crank 22J which is fixed to the outputting shaft 22H of motor 22G with reducer unit. Pin 22K which is the end of the crank 22J is inserted into hole 22M. The slider 22D is reciprocated between, and under the storing section 22P and the position which is out of the storing section 22P by the crank 22J. When the slider 22D doesn't slide, it is located under the storing section 22P.

The motor 22G with a gear transmission reducer unit is controlled by a control device (not shown). Safe 23 which opens below the storing mouth 20 is fixed at the first cover side wall 18A as shown in FIG. 1. The coin entry 4 and the entry 12E of the coin selector 12 are connected by a duct 24, shown by a phantom line.

Next, the operation of this embodiment is explained with regards to loading coins for operation. For example, in the case where the parking fee is 300 Yen and the receiving coin from a user is 500 Yen.

Some receiving coins CR are preliminarily provided in the storing section 22P. First, the lock 3 is unlocked, afterwards the lid 1F is opened. When the lid 1F is opened by 140 degrees, the auxiliary coin entry 17 is located at the right side and is opened by 180 degrees so that the auxiliary coin entry 17 is located at the front of the check-out device 1. The lid 1F is located at the most desirable position, and the 100 Yen coins can be charged into the auxiliary coin entry 17, for example, it can be 10 total coins by an operator.

The 10 reserving coins CR are piled up in the storing section 22P, and the lowest coin CR is located on the slider 22D as shown in FIG. 5. Therefore the storing pipe 22B can't be drawn out, and the reserving coins can only be supplied into the storing section 22B. The reserving coins CR are positioned for dispensing as change. Reserving coins CR can further cushion any shock from coins dropped by the storing section 22P thus cushioning the shock of the falling coins as it contacts the stored coins. Therefore the coins are always piled up horizontally. Next, the lid 1F is closed and is locked by the lock 3, and the preparation for operation finishes.

When a 500 Yen coin is entered into the coin entry 4, the coin C passes through the duct 24 and goes to the coin selector 12 to pass through the entry 12E. The coin selector 12 distinguishes the received coin by referring to the dominations of the coins. Afterwards the coin C is distributed to the storing section based on the distinguished result.

When the coin C is a genuine 500 Yen coin, it is distributed to the storing exit 12H. The coin C drops from the storing exit 12H and is guided by the storing passageway 19T, to drop on the bottom 19E, and slides on the bottom 19E, and passes to the safe 23 through the storing mouth 20.

The control device (not shown) outputs an operating signal to the driver 22E for dispensing 200 Yen in change. Therefore the motor 22G rotates, and the crank is rotated by two rotations. The slider 22D moves towards the left shown in FIG. 5, and it goes away from under the storing section 22P. Therefore the lowest coin CR is located on sliding base 22F. Afterwards the slider 22D moves towards the right and pushes out the lowest coin CR. Therefore the crank 22J rotates in one rotation.

The pushed out coin CR drops to the changing passageway 6A from the dispensing passageway 22R. The coin CR slides on the changing passageway 6A as it is slanted and goes to the changing exit 6 to provide change to the user. The motor 22G rotates, and the crank 22J rotates in more than one rotation. Therefore another coin CR is added so that the sum of 200 Yen is dispensed to the changing exit 6. When another domination of coin C, which cannot be processed (other than a 500 Yen or 100 Yen coin) is inserted, the selector 12 guides the coin C to the returning exit 12G. The coin C drops from the returning exit 12G and drops to the returning passageway 5A guiding the returning passageway 17T. The coin C goes to the coin returning exit 5 and passes through the passageway 5A. When the entered coin C is a 100 Yen coin, the coin selector 12 guides the coin to the receiving exit 12F. The coin C drops from the receiving exit 12F, and drops in the receiving passageway 15T, and goes to the storing section 22P from the upper opening of the storing pipe 22B. The coin C drops on the reserving coins CR, and is stored in a horizontal arrangement.

When a sensor (not shown) detects that the storing section 22P is full, the coin selector 12 guides an additional coin C to the storing unit 12H based on a signal which is output from the control device. In this case, the coin C drops into the safe 23 from the storing mouth 20 and is stored.

A cleaning process for the receiving groove 15D, the returning groove 17D and the storing groove 19D is explained. The lock 3 is unlocked by a service technician, and the lid 1F can be opened. Next, the butterfly screw 21 is loosened, and the handle 18C is grasped so that the cover 18 is lifted up. The first contacting projection 26A, the second contacting projection 26B and the third contacting projection 26C are taken off from the first contacting groove 16A, second contacting groove 16B and third contacting groove 16C.

Next, the cover 18 is moved in a lateral direction away from the side board 11B, and the second contacting projection 26B is taken off from the second contacting groove 16B, and is removed from frame 11. In this situation, the receiving groove 15D and the returning groove 17D are exposed; therefore they can be cleaned by the operator such as with brushes, cloths, and solvents. The opposed parts to the receiving groove 15D and returning groove 17D can be further cleaned. The storing passageway 19T can also be cleaned by the cloths etc., because the passageway 19T is shallow. Therefore the cleaning operation is easy to accomplish by the operator. When the cover 18 is taken off, the storing groove 19D is further exposed. When the storing pipe 22B is clear, the volume of coins in the storing section 22B can be seen through the openings 14A, 14B and 14C, and CR coins can be added if needed. Thus, a coin passageway unit for transporting coins is provided that can be easily cleaned.

A compact and efficient device that can be easily serviced is provided.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A coin receiving and dispensing device comprising:

a coin selector unit with a coin entry for determining a type of coin and directing the coin based on the determination;

a coin dispensing device for storing coins that can be dispensed;

a receiving groove which is operatively connected to the coin selector unit and the coin dispensing device; and a removable cover member that extends over the receiving groove and forms with the receiving groove a first coin passageway between the coin selector unit and the coin dispensing device.

2. The coin receiving and dispensing device of claim 1, further including a coin returning unit operatively connected to the coin selector unit, the coin returning unit includes a returning groove member, the cover member extends over the returning groove and forms with the returning groove a second coin passageway between the coin selector unit and the coin returning unit.

3. The coin receiving and dispensing device of claim 2 further including a housing with an opening with a movable lid member extending over the opening, the coin selector unit, the coin dispensing unit and the removable cover member are supported and movable with the movable lid member.

4. The coin receiving and dispensing device of claim 2 further including a coin storing passageway, the movable cover member forms a portion of the coin storing passageway between the coin selector unit and a coin storage safe.

5. The coin receiving and dispensing device of claim 4 including a housing with an opening with a movable lid member extending over the opening, the returning groove, the receiving groove, and the coin storing passageway are supported and movable with the movable lid member.

6. The coin receiving and dispensing device of claim 3 wherein the coin selector unit is removably mounted on the movable cover.

7. The coin receiving and dispensing device of claim 3 wherein a discharge slot is provided on the movable cover.

8. The coin receiving and dispensing device of claim 3 wherein a coin safe is provided in the housing.

9. A coin payment and change device, comprising:

a housing member with a lockable first cover member movably mounted on the housing member;

a coin receptor opening on the housing member;

a coin selector unit operatively connected to the coin receptor opening for verifying a coin and directing the coin based on the verification;

a coin dispensing device for storing coins that can be dispensed;

a coin return device for returning coins to the user from the coin receptor opening; and a coin passageway unit for operatively connecting the coin selector unit, the coin dispensing device and the coin return device including a removable second cover member forming a part of a first passageway from the coin selector unit to the coin dispensing device and a second passageway from the coin selector unit to the coin return device whereby when the lockable first cover member is moved to provide access to the housing member, the removable second cover member is removable to provide access to the first and second passageways.

10. The coin payment and change device of claim 9, further including a coin returning unit operatively connected to the coin selector unit, the coin returning unit includes a returning groove member, the cover member extends over the returning groove and forms with the returning groove a second coin passageway between the coin selector unit and the coin returning unit.

11. The coin payment and change device of claim 10 wherein the coin selector unit, the coin dispensing unit and the removable second cover member are supported and movable with the movable first cover member.

12. The coin payment and change device of claim 11 wherein the coin selector unit is removably mounted on the movable cover.

13. The coin payment and change device of claim 11 wherein a discharge slot is provided on the movable cover.

14. The coin payment and change device of claim 11 wherein a coin safe is provided in the housing.

15. A coin payment and change device, comprising:

a housing member with a lockable first cover member movably mounted on the housing member;

a coin receptor opening on the housing member;

a coin selector unit operatively connected to the coin receptor opening for verifying a coin and directing the coin based on the verification;

a coin dispensing device for storing coins that can be dispensed;

a coin return device for returning coins to the user from the coin receptor opening;

a coin storage safe for storing coins; and a coin passageway unit for operatively connecting the coin selector unit, the coin dispensing device and the coin return device including a removable second cover member forming a part of a first passageway from the coin selector unit to the coin dispensing device, a second passageway from the coin selector unit to the coin return device, and a third passageway from the coin selector unit to the coin storage safe, whereby when the lockable first cover member is moved to provide access to the housing member, the removable second cover member is removable to provide access to the first and second passageways.

16. The coin payment and change device of claim 15 where the coin dispensing device includes a motor driven member for selectively dispensing stored coins as change to the user.

17. The coin payment and change device of claim 15 wherein the coin selector unit, coin dispensing device, coin return device, coin storage safe, and coin passageway unit are movably mounted on the first cover member.

* * * * *